United States Patent [19]

Allen et al.

[11] 3,981,362

[45] Sept. 21, 1976

[54] IN-SITU COMBUSTION METHOD FOR THE RECOVERY OF HYDROCARBONS

[75] Inventors: Joseph C. Allen, Bellaire; Fuad T. Saadeh, Houston, both of Tex.

[73] Assignee: Texaco Inc., New York, N.Y.

[22] Filed: Mar. 17, 1975

[21] Appl. No.: 558,869

[52] U.S. Cl. ..... 166/260; 166/259

[51] Int. Cl.[2] ..... E21B 43/24

[58] Field of Search ..... 166/259, 260, 261, 262; 432/4

[56] References Cited

UNITED STATES PATENTS

| | | | |
|---|---|---|---|
| 3,010,513 | 11/1961 | Gerner | 166/262 |
| 3,035,638 | 5/1962 | Parker et al. | 166/260 |
| 3,343,598 | 9/1967 | Meldau et al. | 166/262 |
| 3,417,818 | 12/1968 | Dyson | 166/262 |
| 3,638,727 | 2/1972 | Allen et al. | 166/262 |
| 3,672,450 | 6/1972 | Bandyopadayav | 166/260 |
| 3,774,682 | 11/1973 | Bousaid et al. | 166/260 |

*Primary Examiner*—Ernest R. Purser
*Assistant Examiner*—Jack E. Ebel
*Attorney, Agent, or Firm*—Thomas H. Whaley; Carl G. Ries; Charles L. Bauer

[57] ABSTRACT

Hydrocarbons are recovered from a subterranean hydrocarbon-bearing reservoir by in-situ combustion with minimum formation of water of combustion by fracturing the reservoir with a combustible fracturing mixture, burning the fracturing mixture, and thereafter injecting fluidized carbon in an inert gas carrier while at the same time injecting an oxygen-containing gas so that the fluidized carbon is burned in the fractures for thermal stimulation of production of hydrocarbons from the reservoir.

7 Claims, No Drawings

IN-SITU COMBUSTION METHOD FOR THE RECOVERY OF HYDROCARBONS

FIELD OF THE INVENTION

This invention relates to an in-situ combustion method for recovering hydrocarbons from a subterranean hydrocarbon-bearing reservoir by fracturing the reservoir with a combustible fracturing mixture, burning the mixture and thereafter injecting fluidized carbon that is burned in the fractures with minimum formation of water of combustion thereby stimulating production of the reservoir hydrocarbons.

DESCRIPTION OF THE PRIOR ART

In modern day production of hydrocarbons from subterranean formations it is common practice to apply secondary recovery techniques to recover additional quantities of hydrocarbons. Among the more commonly used secondary recovery methods are thermal recovery methods. These methods include steam injection, hot water injection and in-situ combustion. Using these thermal methods, the in-situ hydrocarbons are heated to a temperature at which their viscosity is sufficiently reduced and their mobility is sufficiently improved so as to enhance their flow through the reservoir matrix toward a production well from which they are produced.

In the method of in-situ combustion, combustion is initiated in the subterranean hydrocarbon-bearing reservoir by one of many accepted means such as the use of a downhole gas-fired heater or a downhole electric heater or chemical means. After the face of the stratum adjacent the injection wellbore has been heated to at least 650°F and successful ignition has occurred, an oxygen-containing gas, such as air, is injected into the wellbore to support the combustion and to establish and move a combustion front through the reservoir towards a production well. As the combustion front moves through the reservoir, hot gases and liquids are displaced in advance of the combustion front, vaporize the more volatile components of the reservoir fluids and displace them ahead of the front. The higher boiling point components of the reservoir hydocarbons remain and serve to provide fuel for continuation of the combustion process.

The volatilized components of the reservoir fluids move substantially in the vapor phase until they reach a zone where the temperature of the reservoir is such that they are either condensed or absorbed in the oil. As the front moves through the reservoir a bank of reservoir hydrocarbons is built up ahead of the front which bank is displaced towards a production well from which the hydrocarbons are produced.

In the conventional in-situ combustion method wherein a portion of the hydrocarbons of the reservoir are burned, one of the products of combustion is water. This water is moved ahead of the front principally in the vapor phase together with those more volatile components of the hydrocarbon and condense in the cooler portions of the reservoir. The presence of the water and its intermovement with the hydrocarbons promote the formation of water-oil emulsions, that can create serious and costly problems. These problems include not only the adverse mobility effects because of the emulsion but also the difficulty of breaking the emulsion produced from the production well.

In many reservoirs, particularly limestone type reservoirs, the permeability of the reservoir is so low that production therefrom can be seriously limited. In order to stimulate production in these tight reservoirs one of the methods employed is that of fracturing the reservoir whereby artificial fractures or cleavage planes are formed extending from the wellbore into the hydrocarbon-bearing reservoir. These cleavage planes increase the permeability and porosity of the reservoir and thus provide flow channels which enhance the production of hydrocarbons therefrom.

The most commonly used procedure to induce fracturing is high pressure hydraulic fracturing. In that process, a fluid is displaced down a wellbore and into contact with the hydrocarbon-bearing reservoir at a rate higher than that at which the fluid can flow into and through the reservoir. On continued injection of the fluid, the pressure within the wellbore increases to a pressure at which the reservoir breaks down to create one or more fractures extending outwardly from the wellbore into the reservoir. Hydraulic fracturing fluids generally consist of aqueous liquids, hydrocarbon oils, or oil-water emulsions, to which solid particulate propping agents, viscosity thickeners, or other additives have been added.

Usually, after the artificial fractures have been created around a wellbore within a hydrocarbon-bearing reservoir, the solid particulate propping agents are caused to flow into the fracture. These agents function to hold the fracture at least partially open after release of the fracturing pressure on the fluid in the wellbore and in the fracture thereby providing a high capacity flow conduit to improve the fluid conductivities of the reservoir. While sand is the usual propping agent used for maintaining passages or channels within the fracture leading to the wellbore, other particulate materials such as metal shot, glass beads, and plastics, which have a high compressive strength, are used also.

The present invention seeks to overcome the problems caused by the formation of water of combustion by employing a "dry" in-situ combustion in which there is a minimum formation of water of combustion. The present invention is also applicable to tight reservoirs, i.e. those having low permeability, by utilizing a fracturing technique together with in-situ combustion as set forth herein.

SUMMARY OF THE INVENTION

This invention relates to a method for producing hydrocarbons utilizing in-situ combustion wherein the formation of water of combustion is minimized, by fracturing a reservoir with a combustible fracturing mixture, burning the mixture in the fractures and thereafter injecting into the formation finely divided or fluidized carbon in an inert gas carrier, together with an oxygen-containing gas so as to burn the carbon in the created fractures and to establish a hot inert gas drive through the reservoir.

DESCRIPTION OF THE PREFERRED EMBODIMENT

In the instant invention a combustible fracturing mixture is employed, of the type described in U.S. Pat. No. 3,638,727 which relates to stimulating production from a subterranean hydrocarbon-bearing reservoir. This mixture comprises a combustible hydrocarbon fluid or petroleum fraction, such as kerosene, finely dispersed carbon or charcoal, and a particulate propping agent such as sand. Following the teachings of U.S. Pat. No. 3,638,727, in the instant invention after the reservoir has been fractured by conventional means, the fracture mixture is ignited by any of the techniques well-known in the art, and burned in the created fractures, thereby utilizing the combustibles of the mixture to create hot fracture zones in the reservoir. Once the combustion has been attained and the fracture zones are at temperatures high enough to sustain an in-situ combustion, a fluidized stream of finely dispersed carbon in an inert gas carrier is injected via a wellbore and into the created fractures. Simultaneously therewith, an oxygen-containing gas, such as air, is also injected to establish a "dry" in-situ combustion of the fluidized carbon in the fractures. The combustion of the fluidized carbon occurs upon its contact with the hot matrix of the reservoir.

Injection of the fluidized carbon stream and the oxygen-containing gas stream is continued until a predetermined amount of heat has been generated in-situ and transmitted to the reservoir. By the method of operation the heat transfer renders the in-place hydrocarbons more mobile because of viscosity reduction at the increased temperature. Alternatively, the injection of the fluidized carbon and the oxygen-containing gas can be continued, or once the desired amount of heat generated has been attained, injection of the two streams can be terminated. Thereafter, only a stream of inert gas is injected so as to provide a hot gas drive, whereby the heated hydrocarbon fluids are displaced through the created fractures towards a production well from which they are produced.

In one embodiment of the invention an injection well, that traverses the subterranean hydrocarbon-bearing reservoir, is completed with two tubing strings thereby providing means for the separate and simultaneous injection of the stream of the fluidized carbon in an inert gas carrier and the stream of the oxygen-containing gas.

In the application of this invention, there is first introduced into the subterranean reservoir, via the injection well, a combustible fracturing mixture comprising a combustible hydrocarbon fluid or petroleum fraction such as kerosene, a particulate propping agent such as sand, and finely dispersed charcoal. After a conventional fracturing operation has been conducted by well-known techniques to the point where fracturing has occurred as indicated, for example, by a pressure decline and the mixture has been displaced into the reservoir, the mixture is ignited within the formation stratum immediately adjacent the wellbore by any techniques known in the art, such as downhole gas heaters, electrical heating devices or chemical methods. Once ignition has been initiated, injection of the oxygen-containing gas such as air is continued to maintain the combustion of the fracturing mixture so as to heat the formation to a temperature required for the subsequent combustion of the carbon to be injected. A mixture containing 50,000 pounds of charcoal and 50,000 pounds of sand admixed with 3,500 barrels of kerosene is used for fracturing. After ignition and injection of the oxygen-containing gas, combustion of the fracturing mixture occurs. For an estimated air requirement of 190 MMCF, approximately 30 to 40 days are required to complete the combustion. During this period approximately $1.9 \times 10^{10}$ BTU of heat are generated and a temperature in the reservoir in the range of at least 650°–750°F is attained, which temperature is sufficient to establish the combustion of the fluidized carbon to be subsequently injected.

After combustion of the fracturing mixture has been completed, the injection of the stream of fluidized carbon and an inert gas carrier and the stream of an oxygen-containing gas (i.e., air) is undertaken. The fluidized carbon is forced into the created fractures wherein combustion occurs at the previously created high temperatures in the reservoir. In some instances it may be desirous to continue the simultaneous injection of these streams and produce the reservoir by the "dry" in-situ combustion process as the recovery mechanism. In other instances it may be desirous to terminate the injection of the stream of fluidized carbon in an inert gas carrier once a sufficient amount of heat has been generated in the created fractures. A sufficient amount of heat is that required to bring the reservoir temperature adjacent the fractures to a level such that the reservoir hydrocarbons are sufficiently mobile to be displaced through the reservoir by a subsequent inert gas drive. In some instances, a temperature level of 400°–500°F is sufficient to reduce the viscosity of the hydrocarbons to make them mobile enough for displacement. The following example illustrates the latter case wherein termination of injection after the desired amount of heat has been generated in the created fracture. Utilizing the air injection rate of 6.6 million cubic feet per day, approximately 588 million BTU's per day of heat are generated. For this amount of heat approximately 42,000 lbs. per day of fluidized carbon are used. Once the desired amount of heat has been generated within the reservoir, the injection of the stream of fluidized carbon in an inert gas carrier and the stream of the oxygen-containing gas is terminated. Injection of an inert drive gas is then undertaken whereby the reservoir is produced by hot gas drive.

The inert gas utilized as a carrier for the fluidized carbon and the inert gas that serves as a drive agent may be any inert gas, such as nitrogen, stack gas, flue gas, carbon dioxide and mixtures thereof. In one embodiment of the invention the source of the inert gas may be provided from the gas produced from the production well which is thereafter recycled to the injection well.

By the method of the invention an in-situ combustion is utilized to recover hydrocarbons from a reservoir in which process the formation of water of combustion has been minimized thereby inhibiting emulsion formation of produced hydrocarbons.

The advantages of minimal production of water also make the invention particularly attractive in its application to reservoirs containing water-sensitive clays. In cases of reservoirs containing clays that swell on contact with water conventional thermal techniques are generally precluded. Fresh water condensate hydrates the water-sensitive clays causing them to swell to the extent that the reservoir becomes substantially plugged. The invention also finds application to tight limestone reservoirs that necessitate a fracturing procedure.

We claim:

1. A method of recovering hydrocarbons from a subterranean hydrocarbon-bearing reservoir penetrated by at least one injection well and one production well, utilizing a hot inert gas drive, said reservoir having undergone hydraulic fracturing employing a combustible hydraulic fracturing mixture to create fractures therein, comprising the steps of:

a. injecting via said injection well an oxygen-containing gas into said created fractures in said reservoir containing said hydraulic fracturing mixture, b. initiating an in-situ combustion of said hydraulic fracturing mixture within said fractures of said reservoir, c. continuing injection of said oxygen-containing gas to combust said fracturing mixture to attain a temperature in said fractures in the range of at least 650° to 750°F, d. injecting via said injection well a stream of fluidized carbon in an inert gas carrier and simultaneously continuing injection of said oxygen-containing gas thereby causing combustion of said fluidized carbon in said fractures whereby minimum formation of water of combustion is achieved, e. terminating injection of said stream of fluidized carbon in an inert gas carrier and said oxygen-containing gas after a sufficient amount of heat has been generated by said combustion such that said reservoir hydrocarbons have been rendered mobile, f. injecting via said injection well an inert gas to provide a hot inert gas drive in said reservoir, g. producing said reservoir hydrocarbons via said production well.

2. The method of claim 1, wherein said combustible fracturing mixture comprises a liquid petroleum fraction, finely dispersed charcoal and a particulate propping agent.

3. The method of claim 2, wherein said liquid petroleum fraction is kerosene.

4. The method of claim 1, wherein said oxygen-containing gas is air.

5. The method of claim 1, wherein said inert gas carrier is nitrogen, flue gas, stack gas, carbon dioxide and mixtures thereof.

6. The method of claim 1, wherein said inert drive gas is nitrogen, flue gas, stack gas, carbon dioxide and mixtures thereof.

7. The method of claim 1, wherein said injection well is completed with separate tubing means for injecting simultaneously said stream of fluidized carbon in an inert gas carrier and said stream of oxygen-containing gas.

* * * * *